United States Patent [19]

Jones

[11] Patent Number: 5,007,634

[45] Date of Patent: Apr. 16, 1991

[54] METHOD AND APPARATUS FOR RESTRAINING THE LEGS AND PELVIS FOR EXERCISING AND/OR TESTING THE LOWER TRUNK OF THE HUMAN BODY

[76] Inventor: Arthur A. Jones, 1155 NE. 77th St., Ocala, Fla. 32670

[21] Appl. No.: 361,055

[22] Filed: Jun. 5, 1989

Related U.S. Application Data

[63] Continuation-in-part of Ser. No. 60,679, Jun. 11, 1987, Pat. No. 4,836,536, Ser. No. 236,367, Aug. 25, 1988, Pat. No. 4,902,009, and Ser. No. 181,372, Apr. 14, 1988, Pat. No. 4,834,365, which is a continuation-in-part of Ser. No. 60,679, , said Ser. No. 236,367, is a continuation-in-part of Ser. No. 60,679.

[51] Int. Cl.[5] ..... A63B 21/00

[52] U.S. Cl. ..... 272/134; 297/429

[58] Field of Search ..... 272/96, 97, 117, 118, 272/125, 134, 143, 144; 269/322-328; 128/25 R; 297/423, 429; 73/379

[56] References Cited

U.S. PATENT DOCUMENTS

| | | | |
|---|---|---|---|
| 167,137 | 8/1875 | Tiebout | 272/117 |
| 4,462,252 | 7/1984 | Smidt et al. . | |
| 4,478,411 | 10/1984 | Baldwin . | |
| 4,500,089 | 2/1985 | Jones . | |
| 4,600,196 | 7/1986 | Jones . | |
| 4,700,946 | 10/1987 | Breynig | 272/134 |
| 4,702,108 | 10/1987 | Amondsen et al. | 272/125 X |
| 4,725,055 | 2/1988 | Skowronski | 272/134 |
| 4,725,056 | 2/1988 | Rehrl et al. . | |
| 4,732,380 | 3/1988 | Maag | 272/134 X |
| 4,733,859 | 3/1988 | Kock et al. . | |
| 4,802,462 | 2/1989 | Reiss et al. | 272/134 X |

*Primary Examiner*—Robert Bahr

*Attorney, Agent, or Firm*—William E. Mouzavires

[57] ABSTRACT

Method and apparatus of the present invention fix the legs of a seated human body with the knees bent and the thighs including the femurs extending downwardly and rearwardly with the rear of the pelvis engaged against a pelvic pad located above the rear of the seat on which the body is seated. Forward movement of the legs is restrained by footrests receiving the feet of the body while upward movement of the legs and thighs is prevented by a pad extending across the top of the thighs. Because of the orientation and fixation of the femurs which are connected to the pelvis, the pelvis cannot rotate or pivot and nor can the legs due to their restraint by the thigh pads and footrests. In the apparatus disclosed, the thigh pad is fixed to a pivot arm pivotable in a plane between the legs, and the pad and its pivot arm are held in operative position due to the inclination of the thighs and the restraint of the legs.

13 Claims, 3 Drawing Sheets

10
12
14
16
17
18
19
20
21
30
32
34
36
50
60
60
72
73
74

METHOD AND APPARATUS FOR RESTRAINING THE LEGS AND PELVIS FOR EXERCISING AND/OR TESTING THE LOWER TRUNK OF THE HUMAN BODY

RELATED APPLICATIONS

The present application is a continuation-in-part of my U.S. application Ser. No. 07/060,679, filed June 11, 1987, now U.S. Pat. No. 4,836,536, as well as my U.S. application Ser. No. 07/236,367, filed Aug. 25, 1988, now U.S. Pat. No. 4,902,009, which is a continuation-in-part of the former application Ser. No. 07/060,679 identified above. The present application is also a continuation-in-part of my U.S. application Ser. No. 07/181,372, filed Apr. 14, 1988, now U.S. Pat. No. 4,834,365, which, in turn, is a continuation-in-part of my prior application Ser. No. 07/060,679 identified above. The disclosures and prosecution records of each of my prior applications Ser. Nos. 07/060,679, 07/236,367 and 07/181,372 identified above are hereby incorporated by reference herein as part of this instant application.

OBJECTS OF THE PRESENT INVENTION

The present invention generally relates to methods and apparatus for exercising and/or testing muscles of the lower trunk of the human body as disclosed, for example, in my prior applications Ser. Nos. 07/060,679 and 07/236,367 identified above. More specifically, the present invention relates to methods and apparatus for restraining the legs and pelvis of the human body during exercise and/or testing of the muscles of the lower trunk of the human body, such muscles being, for example, the lumbar or abdominal muscles.

It is an object of the present invention to provide an improved method and apparatus for restraining the legs against movement during exercise or testing of the human body.

Another object of the present invention is to provide an improved method and apparatus for restraining the pelvis against movement during exercise or testing of the lower trunk of the human body. Included herein is such a method and apparatus which is particularly useful with a machine for testing and/or exercising muscles of the lower trunk of the human body such as disclosed in my copending applications Ser. Nos. 07/060,679 and 07/236,367 identified above.

Another object of the present invention is to provide such method and apparatus which may be used to restrain the legs and/or pelvis of the human body in a safe and effective manner while being easy to operate.

SUMMARY OF THE INVENTION

In summary, the method and apparatus of the present invention fixes the legs of a seated human body with the knees bent and the thighs including the femurs extending downwardly and rearwardly with the rear of the pelvis engaged against a pelvic pad located above the rear of the seat on which the body is seated. Forward movement of the legs is restrained by footrests receiving the feet of the body while upward movement of the legs and thighs is prevented by a pad extending across the top of the thighs. Because of the orientation and fixation of the femurs which are connected to the pelvis, the pelvis cannot rotate or pivot and nor can the legs due to their restraint by the thigh pads and footrests. In the preferred embodiment of the apparatus, the thigh pad is fixed to a pivot arm pivotable in a plane between the legs and the pad and its pivot arm are held in operative position due to the inclination of the thighs and the restraint of the legs.

DRAWINGS

Other objects of the present invention will become apparent from the following more detailed description taken in conjunction with the drawings in which.

DETAILED DESCRIPTION

Figure 1:
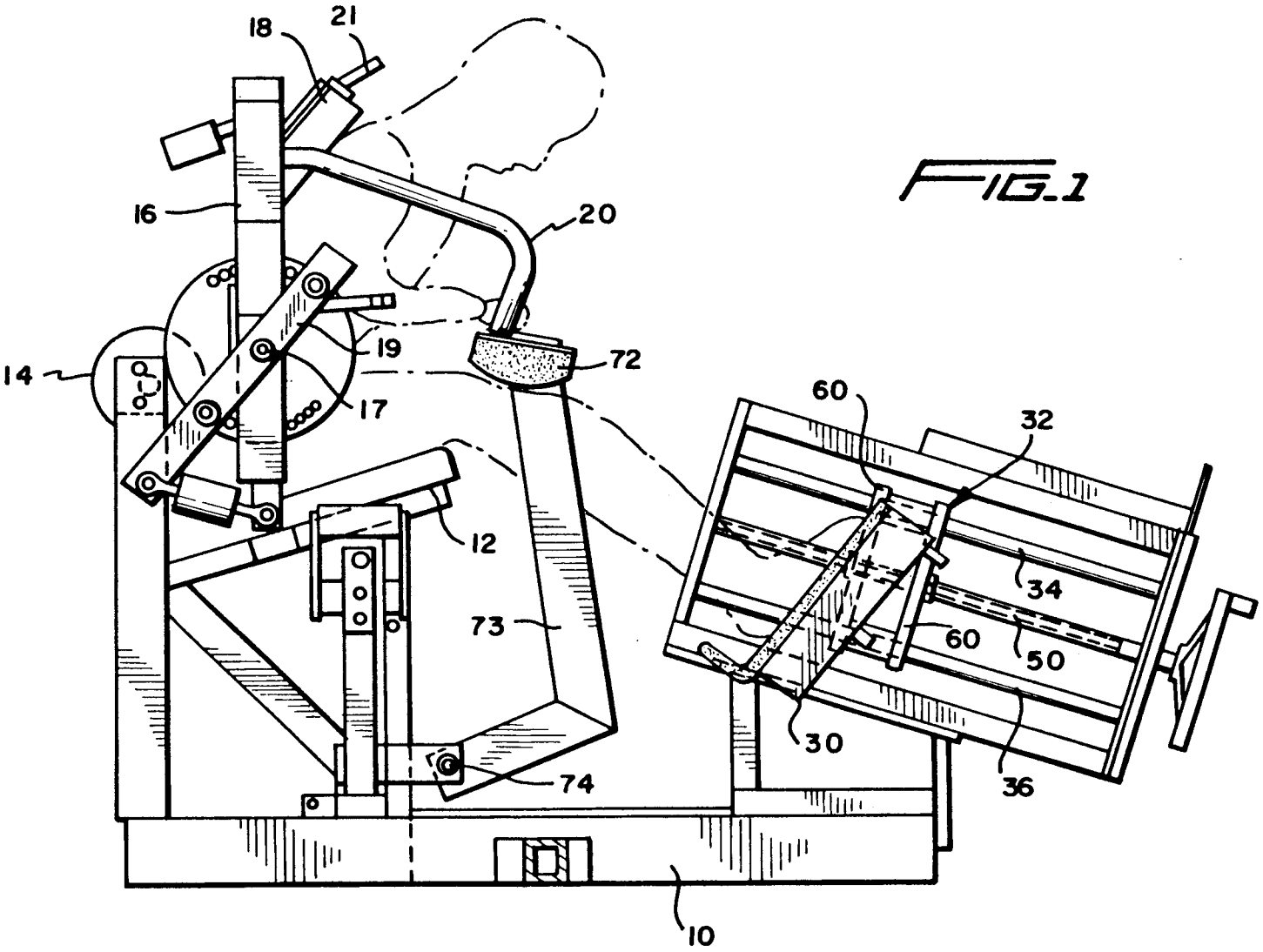
FIG. 1 is a side elevational view of apparatus constituting a preferred embodiment of the present invention shown with portions of a machine for exercising and/or testing the lumbar muscles as seen during an exercise mode.

Referring to the drawings in detail, there is shown for illustrative purposes only apparatus constituting a preferred embodiment of the invention for restraining against movement the legs and pelvis of a human body during exercise of the lower trunk. The apparatus is shown for illustrative purposes only with a machine for exercising and/or testing the lumbar muscles where it is necessary to anchor the pelvis against movement in order to isolate the lumbar muscles from the buttock and hamstring muscles which would otherwise adversely effect the efficiency and accuracy of the testing and/or exercise of the lumbar muscles. The lumbar machine shown includes a fixed base or platform 10 on which is supported in fixed position, a seat 12 which extends downwardly and rearwardly at an oblique angle to the horizontal. At the rear of the seat 12 behind the location of the pelvis is a pelvic-restraint pad 14 for engaging the rear of the body below the lumbar muscles and prevents rearward movement of the buttocks and pelvis. The lumbar machine further includes a movement arm 16 mounted for pivotal movement about a horizontal axis 17 by a force generated by the lumbar muscles and transferred to the movement arm by a resistance pad 18 mounted to the movement arm 16.

Although not shown in the drawings, a resistance or load preferably a compound weight stack of my prior invention disclosed in my applications identified above, is connectable to the movement arm 16 through a toggle assembly 18 to impose a bias on the movement arm 16 which must be overcome by the lumbar muscles each time the movement arm is pivoted counterclockwise as viewed in FIG. 1. During the exercise, the arms of the subject are held in fixed position relative to the movement arm by handle bars 20 fixed to and projecting forwardly of the movement arm to be grasped by the hands of the subject. Although not shown in the drawings, the position of the head is also fixed relative to the movement arm 16 by a headrest (not shown) fixed to the post 21 which is fixed to the resistance pad 18. For a more detailed description of the lumbar machine and the compound weight stack, reference may be had to my prior copending applications Ser. Nos. 07/060,679, 07/236,367 and 07/181,372 which are identified above and which disclosures have been incorporated above into the disclosure of the instant application.

Figure 2:
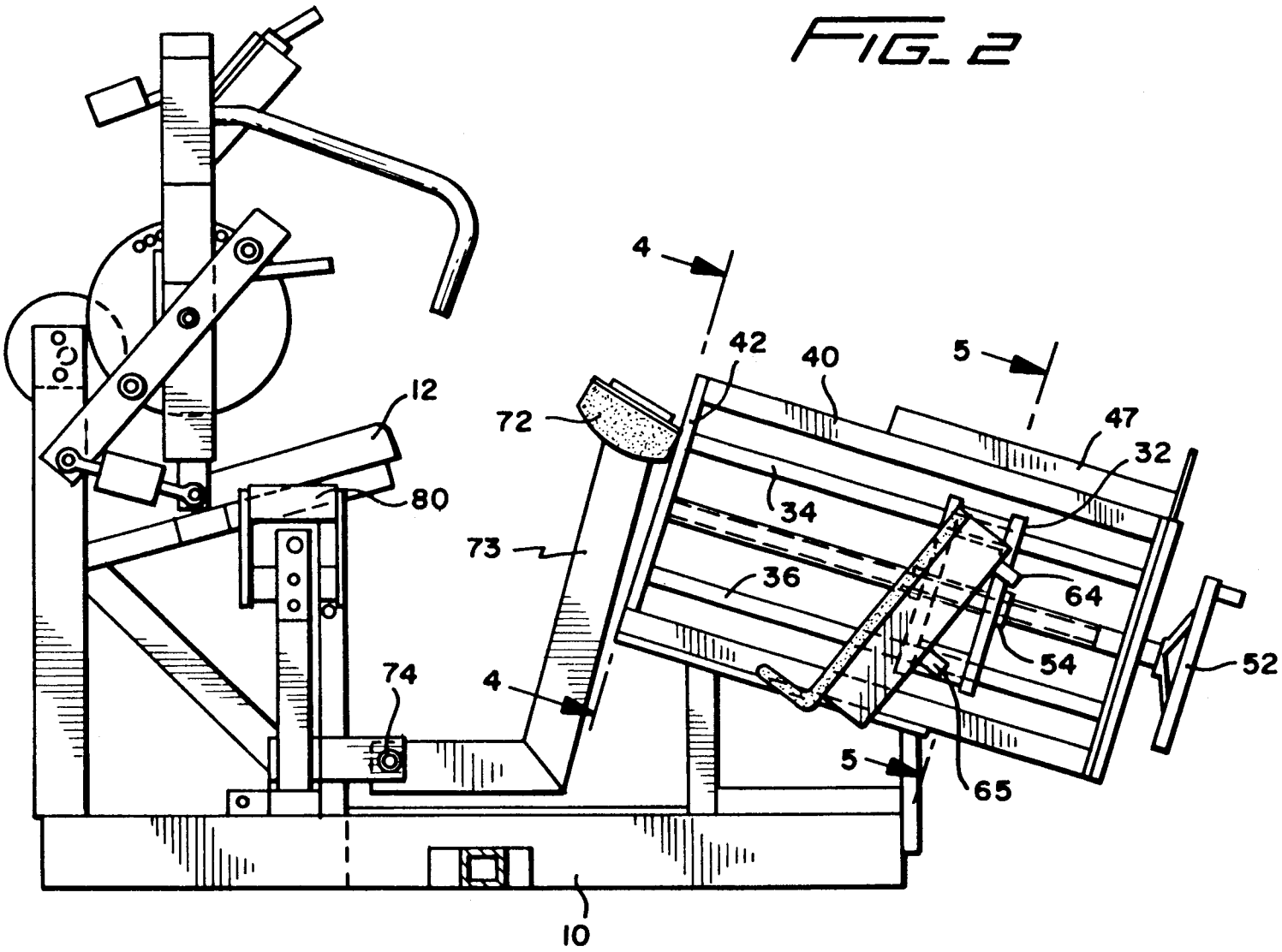
FIG. 2 is a view generally similar to FIG. 1 but with the apparatus in an idle or non-operative position.

Apparatus for restraining the legs against movement in accordance with the present invention includes a pair of footrests generally designated 30 having a rectangular block construction with a liner 31 in the specific form shown. Footrests 30 are fixed by upper and lower struts 64 and 65 to opposite sides of a slide generally designated 32 in FIGS. 1 and 2 with the footrests extending at the angle to the horizontal as shown in the drawings. Slide 32 is mounted for slidable movement on elongated slide rods 34 and 36 which extend at angle to the horizontal as shown in the drawings and with the rods 34, 36, one above the other in parallel in a vertical plane which is aligned with the central axis of the seat 12 as would be located between the legs of the user of the apparatus. Slide rods 34, 36 in the shown embodiment are held in a rectangular frame including upper and lower rigid frame bars 40 fixed to opposite end bars 42 and 43. The slide rod frame is fixed to the base 10 at an angle to the horizontal as shown, by vertical legs 44 and 45 upstanding from the base 10 to which they are fixed. In the preferred embodiment, a frame partially shown at 47 in FIG. 3 is fixed across the top frame bar 40 to support a video screen and register (not shown) for displaying the forces generated during operation and the position of the slide respectively.

Figure 3:
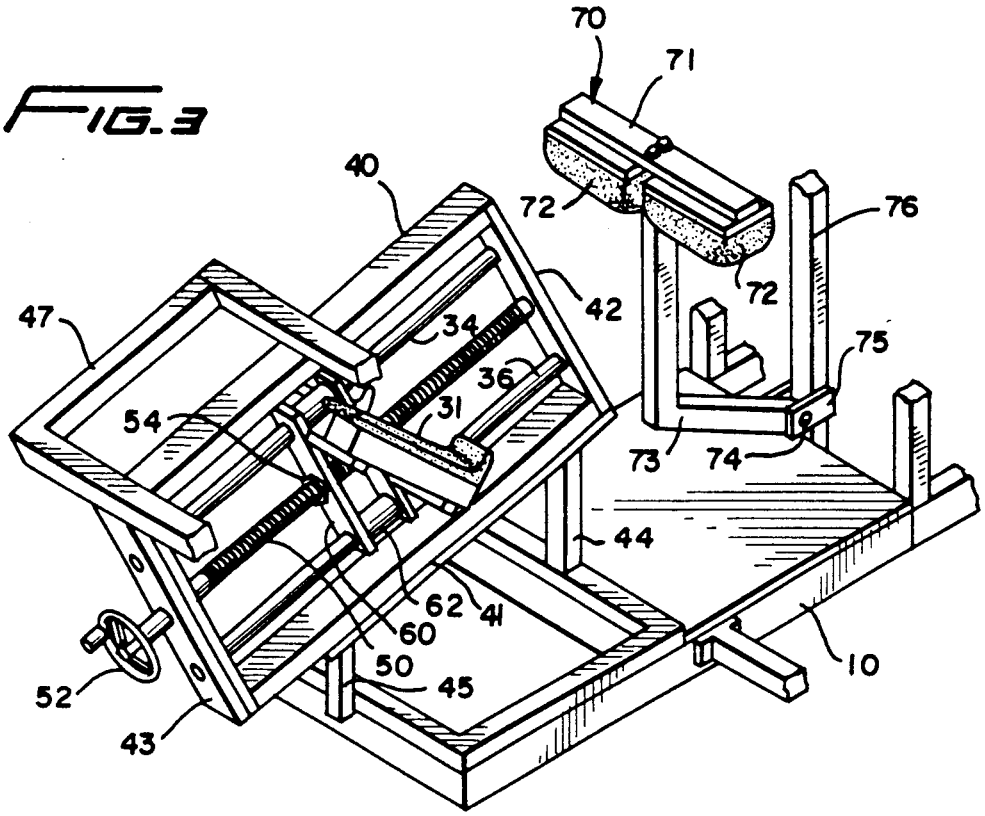
FIG. 3 is a fragmental perspective view of the apparatus shown in the non-operative position.
Figure 4:
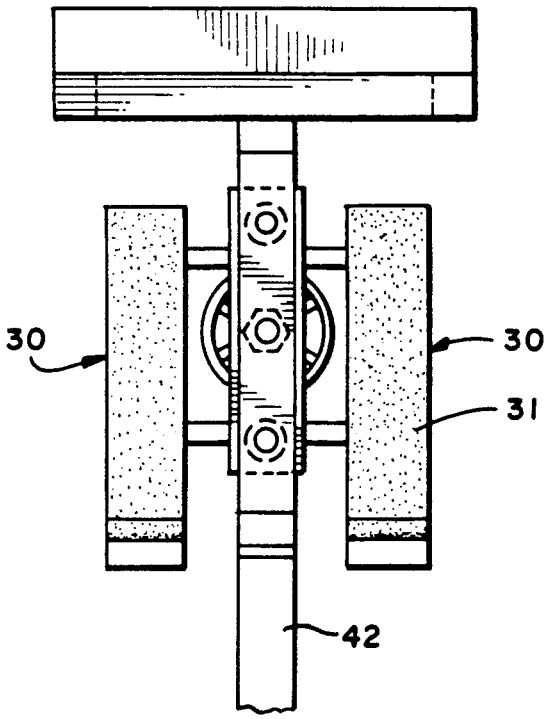
FIG. 4 is an enlarged fragmental cross-sectional view taken generally along lines 4—4 of FIG. 2.
Figure 5:
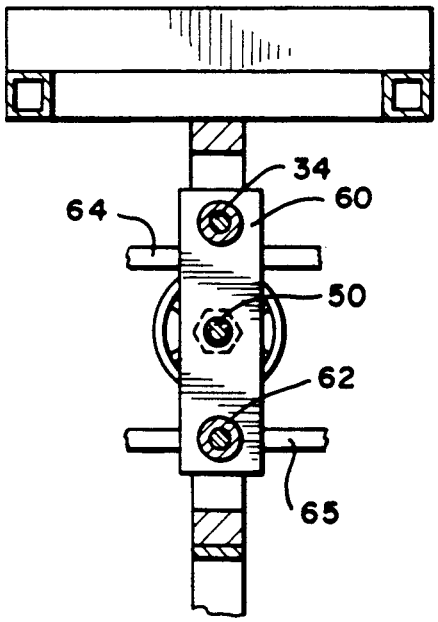
FIG. 5 is an enlarged, fragmental cross-sectional view taken generally along lines 5—5 of FIG. 2.

Referring to FIGS. 1 and 3, the slide 32 in the specific embodiment shown includes a pair of parallel plates 60 interconnected by tubular bushings 62 which are slidable on the slide rods 34 and 36 respectively. Bushings 62 are rigidly fixed to slide plates 60 such as by welding, and the plates 60 each have upper and lower apertures which receive the rods 34 and 36 so that the slide extends ninety degrees relative to the rods 34, 36 and is slidable along the same at the inclined angle of the rods shown in the drawings. The struts 64 and 65 from the footrests 30 are fixed to the slide plates 60 to move with the slide 32 along the rods 34, 36.

Referring to FIG. 3, actuation of the slide 32 in the specific embodiment shown is achieved by a screw rod 50 mounted for rotation only, in the end bars 42, 43 of the slide rod frame. A nut 54 engaged on the threads of the screw 50 is fixed to one of the slide plates 60 so that rotation of the screw rod 50 will cause the slide 32 to move along the screw rod 50 and slide rods 34, 36. A hand wheel 52 is fixed to the screw rod 50 outwardly of the frame bar 43 so that rotation of the wheel 52 in one direction will advance the slide 32 and footrests 30 towards the seat 12 and rotation of the wheel 52 in the opposite direction will retract the footrests away from the seat 12.

The leg restraining apparatus further includes means for preventing upward movement of the thighs while the calves and feet are prevented from forward movement and pivotal movement about the knees by the footrests 30. In the shown embodiment, this means is provided by what will be termed a "thigh restraint" generally designated 70 engageable across the tops of the thighs just behind the knees to prevent upward movement of the thighs. In the preferred embodiment shown, thigh restraint 70 is fixed to a pivot arm 73 having a generally L-shape and located in alignment with the vertical plane of the slide frames 40, 42 so as to be receivable between the legs of the subject. Pivot arm 73 is mounted for pivotal movement about a horizontal axis provided by pivot pin 74 between an idle or non-operative position shown in FIG. 2 where it is spaced from the seat 12 to give access to the seat 12, and an operative position shown in FIG. 1 wherein it is closer to the seat 12 so as to place the thigh restraint 70 over and in engagement with the tops of the thighs just behind the knees. In the specific embodiment, the thigh restraint includes a pair of pads 72 fixed to a yoke bar 71 on opposite sides of the pivot arm 73. Pivot 74 is received in blocks 75 fixed to an upright frame post 76. In the inoperative position shown in FIG. 2, pivot arm 73 rests against the slide frame 42.

In use of the apparatus, the subject is seated and the pivot arm 73 is moved between the subject's legs with the thigh pad 72 overlying the thighs. The subject's feet are placed on the footrests 30 and slide 32 is actuated through hand wheel 52 to place the footrests 30 in a position where the subject's knees are bent and pressure is exerted by the thighs on the thigh restraint pads 72 and vice versa so that thigh restraint 72 is held in position by engagement with the thighs and the latter are prevented by the thigh restraint 72 from moving upwardly. Moveover, since the footrests 30 prevent movement of the calves and feet, the legs of the subject are effectively locked in position against movement. In addition, the femurs extend downwardly and rearwardly at an angle over the seat 12 and lock the pelvis against movement.

If desired, the thighs may be further restrained against movement by seat straps 80 buckled together over the thighs rearwardly of the thigh restraint 72.

The above leg-restraining apparatus avoids the need to apply pressure to the shins in order to fix the legs and is therefore believed to be an improvement over my prior apparatus for securing the legs. In addition, pressure imparted to the legs by the footrests 30 during adjustment is received by the bottoms of the feet which are capable of withstanding such pressure. Furthermore, the pivot arm 24 due to its pivotable nature, coupled with the adjustability of the footrests 30 makes the apparatus adjustable to suit subjects of different sizes. Yet, at the same time, the apparatus is simple to use and effective to prevent movement of the legs with safety.

Although the leg-restraining apparatus of the present invention has been shown and described in conjunction with a lumbar exercise and/or testing machine, it will have applicability to other types of exercise and/or testing machines or other machines where it is necessary to secure the legs against movement.

What is claimed is:

1. In combination with a machine for exercising lower trunk portions of the human body and including a seat, apparatus for restraining movement of the pelvis of a person seated on said seat, the apparatus comprising a pelvic pad located rearwardly of said seat to engage the body at the rear of the pelvis, and leg restraining apparatus for preventing movement of the pelvis comprising in combination, footrest means for supporting the feet with the legs bent at the knees and with the femurs extending downwardly and rearwardly of the seat, and a thigh restraining means movable between a first position spaced from the thighs and a second position overlying and engaging the thighs to prevent upward movement of the legs while lower movement of the legs is prevented by said footrest means, and means mounting the footrest means for adjustable movement along a generally horizontal direction towards or away from the legs of the person to be restrained for placing the legs in a desired position to be restrained, and wherein said footrest means extends at an angle to the horizontal for supporting the feet at said angle to the horizontal.

2. A leg restraining apparatus for restraining the legs of a seated person, the apparatus comprising in combination, footrest means for supporting the feet with the legs bent at the knees, a thigh restraining means movable between a first position spaced from the thighs and a second position overlying and engaging the thighs to prevent upward movement of the legs while the lower movement of the legs is prevented by said footrest means, and means mounting the footrest means for adjustable movement along a generally horizontal path towards or away from the feet and person to be restrained for placing the legs in a desired position to be restrained with the legs bent at the knees, said means mounting the footrest means including a guide rod extending generally horizontally, a slide slidable on the guide rod and connected to the footrest means for moving the footrest means along the slide, and actuating means for moving the slide along the guide rod including a screw rod, a nut fixed to the slide and engaged about threads on the screw rod, and means for rotating said screw rod for advancing said slide along the screw rod and wherein the footrest means extends at an angle to the horizontal to place the feet at said angle to the horizontal and wherein said thigh restraining means includes an arm mounted for pivotal movement substantially below a level at which the person is seated.

3. A leg restraining apparatus for restraining the legs of a seated person, the apparatus comprising in combination, footrests extending at an angle to the horizontal for supporting the feet at an angle to the horizontal with the legs bent at the knees, and a thigh restraining means movable between a first position spaced from the thighs and a second position overlying and engaging the thighs to prevent upward movement of the legs while lower movement of the legs is prevented by said footrests, and means mounting the footrests for adjustable movement along a generally horizontal path towards or away from the legs of the person to be restrained for placing the legs in a desired position to be restrained and with the feet at angle to the horizontal.

4. The apparatus defined in claim 3 wherein said footrests are adjustable towards the legs along a path which extends upwardly at an angle to the horizontal.

5. The apparatus defined in claim 3 including actuating means for adjusting the position of the footrests.

6. The apparatus defined in claim 3 wherein said thigh restraining means includes an arm mounted for pivotal movement about a horizontal axis.

7. Apparatus defined in claim 4 wherein said thigh restraining means includes an arm mounted for pivotal movement about a horizontal axis.

8. Apparatus defined in claim 3 wherein said means mounting the footrests includes a guide rod, extending generally horizontally a slide slidable on the guide rod and connected to the footrests, and actuating means for moving the slide along the guide rod.

9. The apparatus defined in claim 8 wherein said actuating means includes a screw rod, a nut fixed to the slide and engaged about threads on the screw rod, and means for rotating said screw rod.

10. Apparatus defined in claim 6 wherein said thigh restraining means includes a pad fixed to the arm to extend across and over the thighs with the arm located between the thighs.

11. Apparatus defined in claim 3 wherein said thigh-restraining means is engageable over the thighs just behind the knees and wherein there is further included strap means engageable over the thighs rearwardly of the thigh-restraining means.

12. Apparatus defined in claim 8 wherein said guide rod extends at an upward angle towards the legs relative to the horizontal.

13. Apparatus defined in claim 12 wherein said footrests extend at an angle to the guide rod.

* * * * *